United States Patent [19]

Dashew

[11] 3,966,164

[45] June 29, 1976

[54] ADJUSTABLE TRUSS SUPPORT AND FORM FOR CONCRETE CONSTRUCTION

[75] Inventor: Stephen S. Dashew, Palos Verdes, Calif.

[73] Assignee: Interform, Inc., Compton, Calif.

[22] Filed: Feb. 5, 1975

[21] Appl. No.: 547,232

Related U.S. Application Data

[62] Division of Ser. No. 387,967, Aug. 13, 1973, Pat. No. 3,902,289.

[52] U.S. Cl. ..... 249/18; 249/28; 249/210; 425/62

[51] Int. Cl.[2] ..... E04G 11/40

[58] Field of Search ..... 249/13, 18, 28–32, 249/210; 52/637–638; 182/182–184; 425/62

[56] References Cited

UNITED STATES PATENTS

| | | | |
|---|---|---|---|
| 1,498,665 | 6/1924 | MacIvor | 249/210 |
| 1,658,535 | 2/1928 | Neilson, Sr. | 52/638 |
| 1,958,933 | 5/1934 | Williams | 249/28 |
| 3,579,759 | 5/1971 | Zuccolo | 425/62 |
| 3,744,945 | 7/1973 | Metrailer | 249/18 |
| 3,787,020 | 1/1974 | Avery | 249/18 |

FOREIGN PATENTS OR APPLICATIONS

| | | | |
|---|---|---|---|
| 1,763 | 6/1908 | United Kingdom | 182/183 |

*Primary Examiner*—Francis S. Husar
*Assistant Examiner*—John McQuade
*Attorney, Agent, or Firm*—Lindenberg, Freilich, Wasserman, Rosen & Fernandez

[57] ABSTRACT

A framework of structural members having the appearance of a truss, for supporting concrete forms that mold the floors of buildings, including upper and lower beams joined by vertical upper column members and diagonal members, lower column members that support each upper column member on the floor, and screw jacks at the bottoms of the lower column members to permit fine height adjustments. The fact that each upper column member is separately supported by an adjustable device that assures proper vertical positioning, means that there are minimal bending stresses in the upper and lower beams during the heavy loading which occurs when supporting poured concrete, so that the structural members can be constructed of a material of high strength but low rigidity such as aluminum.

2 Claims, 17 Drawing Figures

Fig. 3
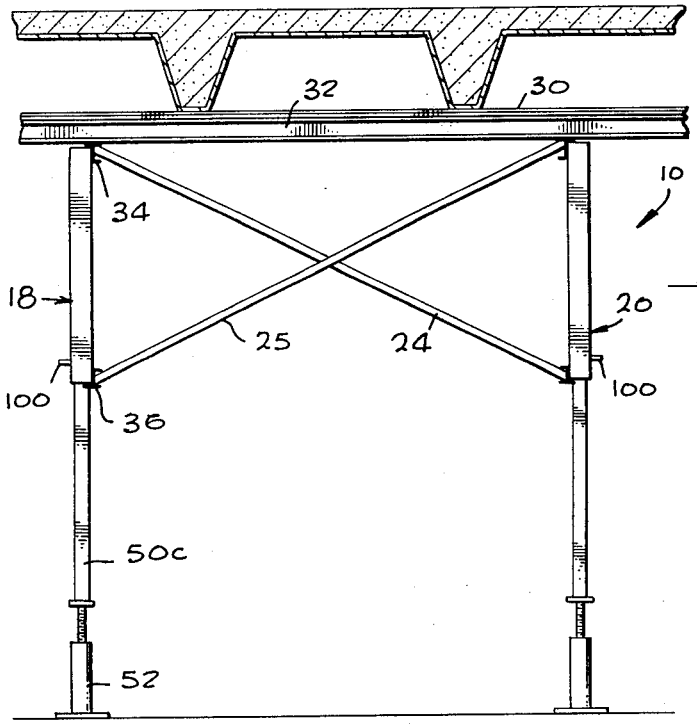
Fig. 4
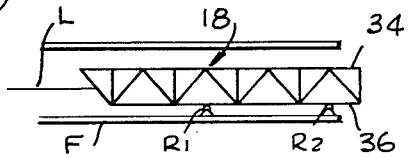
Fig. 5
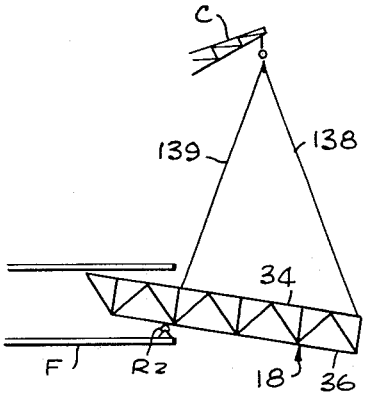
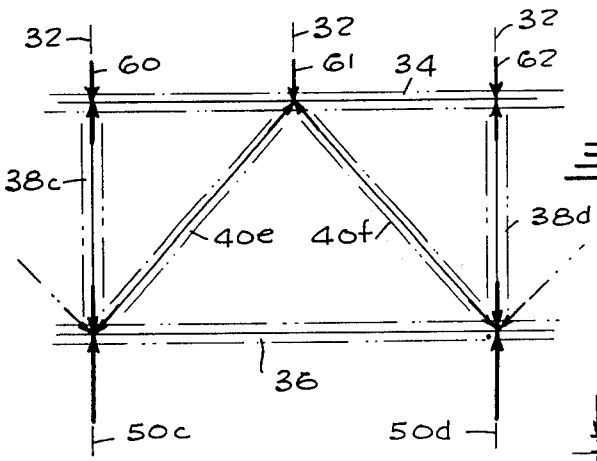
Fig. 6
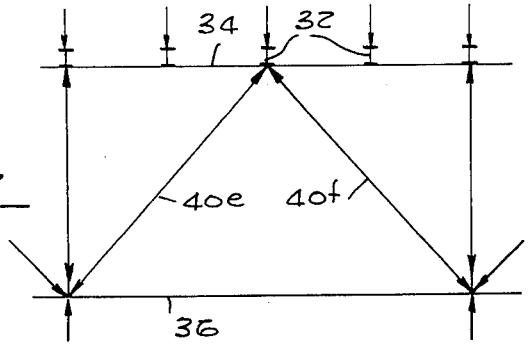
Fig. 7

10
24
38c
102
40e
36
10
18
40f
34
40e
76
70
38c
80

38c
24
102
104
36

102
24
96
92
40d
72
36
94
84
100
50c
98
85
88
90
82
52
110
10
112
114
120
122
118
36
130
116
124
126
128

ADJUSTABLE TRUSS SUPPORT AND FORM FOR CONCRETE CONSTRUCTION

This is a division of application Ser. No. 387,967, filed Aug. 13, 1973 now U.S. Pat. No. 3,902,289.

BACKGROUND OF THE INVENTION

This invention relates to an apparatus used to support concrete forms of a type that are utilized to mold floors.

Concrete floors of a multi-storied building are often formed by the use of plywood or fiberglass forms that are supported by small beams or purlins, the purlins being supported by shoring apparatus that extends to the ground or to the floor lying below the one being formed. For many years, the shoring has been constructed by utilizing lumber or pipes that were disassembled after each use, moved to a new location, and reassembled. However, considerable time is required to assemble and disassemble such shoring structures. In order to save labor, long frameworks have been constructed which are moved by a heavy crane from one location to another, particularly in constructing the many stories of high rise buildings. Each framework was in the form of a truss with many steel members, the truss having a height such as 8 feet and a length such as 30 feet. While the truss eliminated considerable labor, substantial time was still utilized in positioning the truss at the proper height, particularly where different ceiling heights are utilized in different stories of a building. Also, the trusses were constructed of heavy steel members, not for strength, but to minimize deflection under the heavy loading of poured concrete. Beams of steel were normally utilized rather than a high strength aluminum alloy which may have about the same strength as steel, because aluminum has a much lower modulus of elasticity, and therefore larger deflections could occur which would result in a floor that sagged. If the frameworks could be constructed of lighter weight materials and with fewer members, without decreasing rigidity under heavy loading, then longer frameworks could be utilized because their weight would be low enough to permit movement by available cranes.

SUMMARY OF THE INVENTION

In accordance with one embodiment of the present invention, a shoring apparatus is provided for supporting concrete floor forms, including a light weight framework that can be readily moved as a unit to different locations of a building site and which can be readily positioned thereat. The moveable framework of the apparatus includes a horizontal upper beam, a horizontal lower beam, several vertical tubular upper column members, and several diagonal members. The upper column members are joined at their upper ends to the upper beam at locations approximately halfway between the upper column members, and are joined at their lower ends to lower beam locations adjacent to the lower ends of the column members. A group of lower column members is also provided, which slide within the upper column members and which extend down to screw jacks that lie on the ground or a lower floor. Each lower column member can be fixed at different slideable positions with respect to a corresponding upper column member by inserting a pin through corresponding holes of the members, in order to make a gross adjustment of the support height, the screw jacks permitting a fine height adjustment.

When the shoring apparatus is set up to support concrete forms, nearly the entire loading of the framework is transmitted through compression loading of the column and diagonal members, with little if any bending forces being transmitted through either the upper or lower beams. As a result, any sagging deflection under the weight of poured concrete results from lengthwise shortening of the columns and diagonal members, which is normally negligable. The usual type of sagging, due to deflection of a beam, will not occur to a great extent. As a result, many of the structural members can be constructed of a material of high strength, such as certain aluminum alloys, even though the material is not as rigid as steel (that is, even though it has a much lower modulus of elasticity). Relatively light weight materials can be utilized for the structural members which not only reduces cost but also facilitates the movement of the long structural framework between different locations at the building site.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 3 is a partial front elevation view of the apparatus of FIG. 1;

FIG. 4 is a simplified side elevation view, showing how a framework structure of the apparatus of FIG. 1 is moved from one floor level to another in a building site;

FIG. 5 is a view of the framework of FIG. 4, showing it at a later time in the moving operation;

FIG. 6 is a diagrammatic view of a portion of the structure of FIG. 2, showing the forces applied thereto;

FIG. 7 is a view similar to FIG. 6, but for an altered loading arrangement;

DESCRIPTION OF THE PREFERRED EMBODIMENTS

Figure 1:
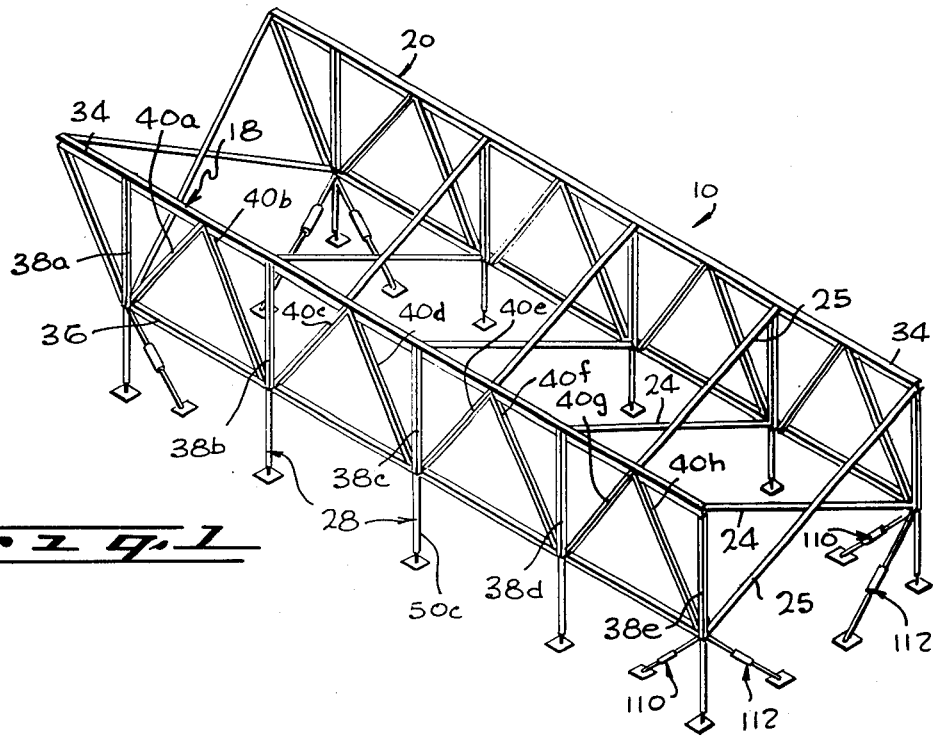
FIG. 1 is a simplified perspective view of a shoring apparatus constructed in accordance with the invention.
Figure 2:
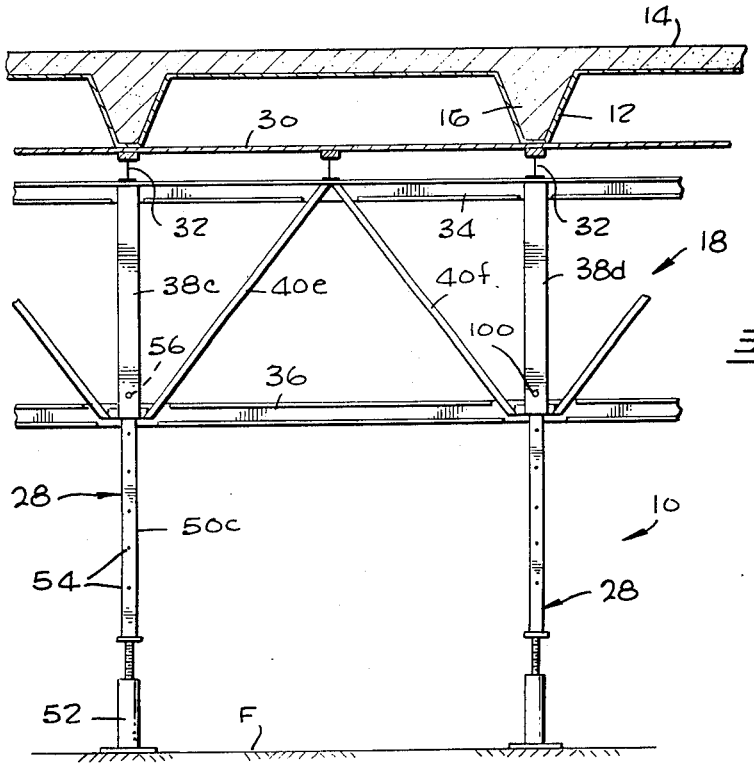
FIG. 2 is a partial side elevation view of the apparatus of FIG. 1, showing how it is used to support concrete forms in the molding of concrete floors.

FIGS. 1–3 illustrate a shoring apparatus 10 which is utilized to support forms 12 that mold concrete floors 14. The floor 14 includes integral concrete beams 16 that strengthen it, although the shoring apparatus can be used in slab floor construction where there are no integral floor beams. The shoring apparatus includes a pair of elongated framework structures 18, 20 that extend parallel to one another and which are braced against one another by several bracing members 24 and 25. Each of the framework structures 18, 20 is supported on the floor below by a group of lower column means 28 that re are adjustable in height. The concrete forms 12 are supported on a deck 30 which is, in turn, supported by several purlins 32 that extend across the tops of the framework structures 18, 20.

Each framework structure such as structure 18 shown in FIG. 2, includes a horizontal upper beam 34, a horizontal lower beam 36, a series of upper column members 38*a* –38*e*, and a group of diagonal members 40*a* –40*h*. The upper column members are fastened at their upper and lower ends to the upper and lower beams 34, 36, respectively. Each diagonal member such as 40*e* has a lower end that is attached near the intersection of the lower beam 36 with one of the upper column members 38*c*, and has an upper end attached to the upper beam 34 at a point approximately midway between the two upper column members 38*c* and 38*d*.

Each of the lower column means 28 that support the framework structure 18 on an already formed floor F or on the ground, includes a lower column member such as 50*c* and a jack 52 that supports the lower column member on the floor. Each upper column member such as 38*c* is a tube, and the lower column member 50 can slide within the tube formed by the upper column member to permit an adjustment of the support height. The lower column member 50*c* has a group of several holes 54, while the upper column member has a corresponding hole 56, so that a pin inserted through the hole 56 can be used to fix the relative slideable positions of the column members. This provision for large adjustments, plus the fine adjustability of the jack 52, permits control of the precise height of each of the upper column members 38 over a wide range of heights.

The shoring structure is designed to permit rapid movement and setup at different locations in a building, by moving each of the framework structures 18, 20 as a unit. When the framework structures are supporting the concrete forms that are filled with wet cement, the structures 18 and 20 are highly stressed but in a largely uniform manner along their lengths. When a framework structure such as 18 is being moved by a crane from one floor to another, as illustrated in FIGS. 4 and 5, the only load applied is due to the weight of the structures, but the load may be highly concentrated and stresses are induced in a very different manner than when the structures are supporting concrete forms. In many practical structures, the most likely type of failure is that which can occur during movement of a structure as illustrated in FIG. 5, rather than during support of poured concrete. However, the design of the framework structures is largely based on the need to prevent sagging during the support of poured concrete. A large degree of sagging of the shoring structure, which would lead to a floor that sagged considerably, must be prevented. The shoring structure of the present invention is designed to minimize deflection under the weight of poured concrete, but utilizing a light weight structure to facilitate movement around the building site.

FIG. 6 illustrates the type of forces established in the portion of the structure which is illustrated in FIG. 2, under the loading of poured concrete. The purlins 32 transmit the weight forces represented by the arrows 60, 61, and 62 to the upper beam 34. Two of the purlins lie directly over the vertical upper column member 38*c*, 38*d*. They produce forces 60, 62 that are transmitted directly through the upper column members 38*c*, 38*d* to the lower column members 50*c*, 50*d*, with all upper and lower column members being loaded only in axial compression. The force 61 which is applied to the upper beam 34, can be transmitted directly through the two diagonal members 40*e*, 40*f* to the lower column members 50*c*, 50*d*, by simple axial compression of the diagonal members. So long as the lower column members 50*c*, 50*d* are both supported at the same height, little if any bending occurs in either the upper beam 34 or the lower beam 36.

The fact that the members of the framework 18 are loaded almost only in axial compression, means that very little deflection will occur in the shoring structure, and therefore, the floors will not sag even though light weight structural members are utilized. In most prior shoring structures and trusses, a considerable portion of the loading of wet concrete induced bending of beams, which can result in considerable deflection unless heavy-duty beams are utilized or the beams are strengthened at very close intervals along their lengths. Where the loading is primarily in the form of axial compression, almost no deflection occurs until a member begins to undergo a column collapse, which occurs only just before failure. The amount of beam shortening due to elasticity of the beam material is normally negligible. The fact that the major loading is axial or column-like compression means that a material of a low modulus of elasticity, such as aluminum, can be readily used in the structural members. Aluminum alloys are available which are of high strength, so that the members may have about the same ultimate strength as similar members constructed of steel. However, all aluminum alloys have approximately the same Young's modulus of elasticity, of about $10 \times 10^6$, which is about one-third that of steel. Thus, an aluminum beam is likely to sag much more than a steel beam of the same size, even though the two beams may be able to carry about the same load before failure. By eliminating large bending moments in the structure, sagging is largely eliminated even though a material of low modulus of elasticity such as aluminum is utilized for the structural members. A largely aluminum framework 18 may deflect considerably during movement within the building, in the manner shown in FIGS. 4 and 5, but this is not important so as long as the structure does not fail. It may be noted that the purlins 32 may sometimes be located closer together, as in FIG. 7, which results in bending moments being applied to the upper beam 34. However, only a moderate bending moment is applied because the beam 34 is supported against bending at both the upper column members and the tops of the diagonal members 40*e*, 40*f*, and because a large proportion of the purlins lie near or directly over an upper column member or the top of a diagonal member. Even in loading of the type illustrated in FIG. 7, the lower beam 36 is not heavily loaded in a bending mode.

FIGS. 8–11 illustrate details of the shoring structure, showing the shapes of the structural members and their manner of joining. The upper column member 38*c* is a square tube and has mounting plates 70, 72 welded to its upper and lower ends. The upper beam 34 has a cross-sectional shape in the form of a "J", with a vertical web, a pair of upper flanges 76, and a lower flange 80 that lies on a side of the web opposite the upper column member. The upper mounting plate 70 on the upper column member is attached by bolts to the web of the upper beam 34. The lower beam 36 has a cross-section in the shape of an "I", with a vertical web 82 and with upper flanges 84, 86, and lower flanges 88, 90. The upper and lower flanges 86, 90 are cut-away near each column member such as 38*e*, to facilitate fastening to the lower beam. The lower mounting plate 72 on the upper column member is attached by bolts to the web of the lower beam 36. The diagonal members such as 40*d* and 40*e* have an "I" cross section, and their upper and lower flanges 92, 94 on one side of the web 96 are cut away near the lower ends of the diagonal members to facilitate fastening of the webs 96 to the web 82 of the lower beam 36. The webs 96, 82 are fastened by a pair of bolts 98. The upper ends of the diagonal members are similarly cut-away and fastened by bolts to the web of the upper beam. The lower column member 50*c* is also in the form of a tube, and it is held at a fixed position relative to the upper column member by a pin 100. The braces, such as brace 24 which extends between the two framework structures, is attached to the lower column member 38*c* by a lug 102 that is welded to the upper column member 38*e* and which is held by a bolt 104 to the brace.

Most of the structural members of the framework 18 are constructed of a light weight but high strength material such as a high strength aluminum alloy. The upper and lower beams 34, 36 as well as the diagonal members 40*a*–40*h* are constructed of aluminum. The upper column members 38*a*–38*e*, however, are constructed of steel. Steel is used because it is often difficult to extrude aluminum in a closed or tubular shape. The upper and lower beams and diagonal members are all of shapes that can be readily extruded so that they can be readily constructed of aluminum. As discussed above, a material such as aluminum can be readily utilized even though it has a low modulus of elasticity, because the framework structure is constructed to minimize deflections even though highly elastic material is utilized.

Figures 8, 9, 10, 11:
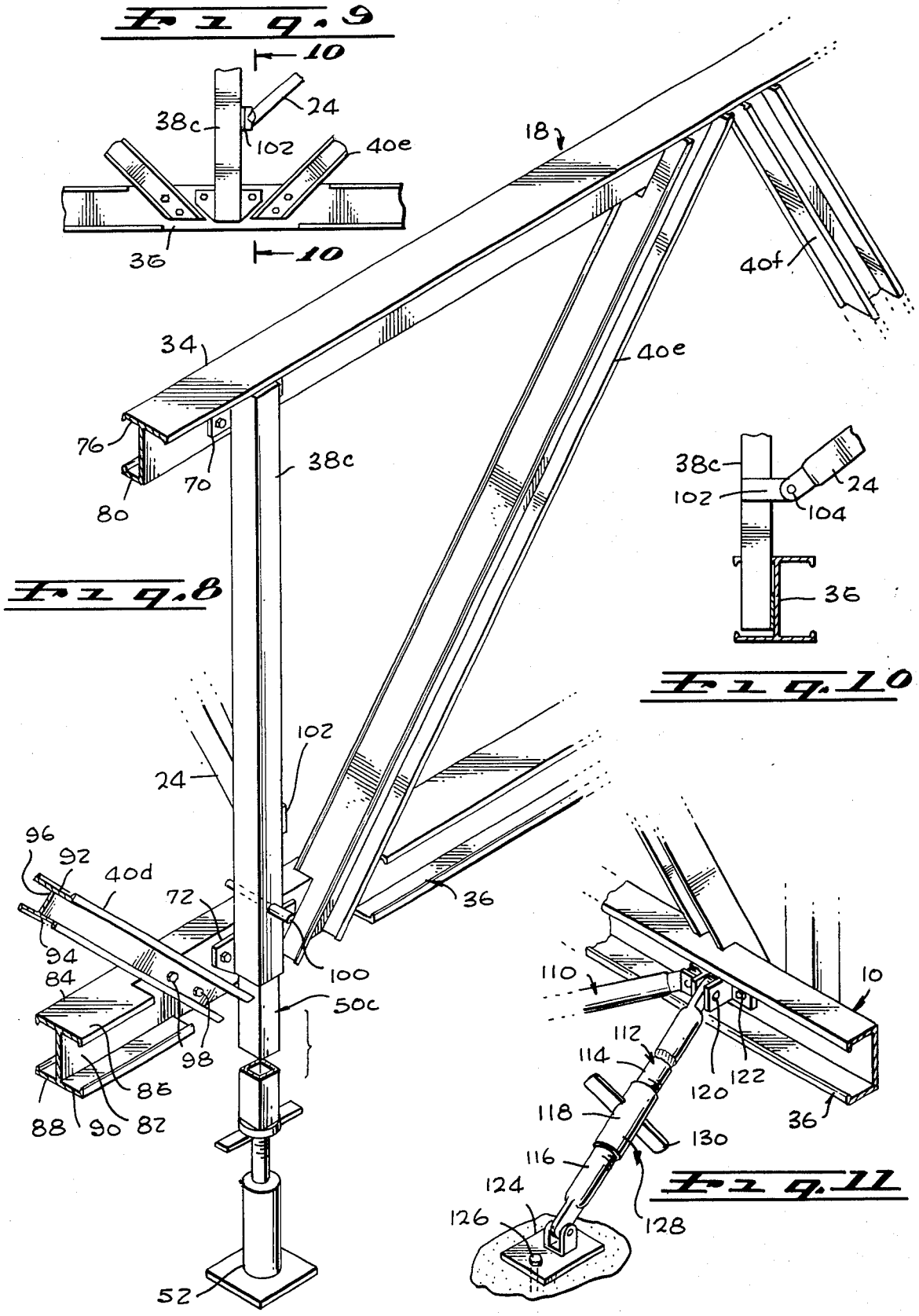
FIG. 8 is a partial perspective view of the apparatus of FIG. 2, showing details of the connections thereof.
FIG. 9 is a partial front elevation view of the apparatus of FIG. 8.
FIG. 10 is a partial view taken on the line 10—10 of FIG. 9.
FIG. 11 is a partial perspective view of the apparatus of FIG. 1, showing a corner brace thereof.

In many situations, it is desirable to provide braces at the corners of the shoring apparatus such as those shown in FIG. 1 at 110, 112. Such corner braces can resist sideward swaying of the entire shoring apparatus, and substantially eliminate danger of the shoring apparatus collapsing to one side. In accordance with the present invention, corner braces 110, 112 are provided which are adjustable in length to permit controlled sideward shifting of the shoring apparatus so as to adjust for slight misallignment, that is, to shift the upper part of the shoring apparatus by a small amount in any horizontal direction. FIG. 11 illustrates details of one of the corner braces 112. The brace 112 includes upper and lower pipe or brace members 114, 116 connected by a coupling 118. The upper end of the pipe member 114 is pivotally connected by a bolt 120 to a bracket 122 that is mounted on the lower beam 36. The lower end of the lower pipe member 116 is pivotally connected to a plate-like shoe 124 that is held by a bolt 126 to the floor that lies below the one being formed, the bolt 126 often being a member shot into concrete by a special gun.

The coupling 118 is internally threaded, and the adjacent ends of the pipe members 114, 116 are also threaded. The lower end of pipe 114 has a right hand thread while the upper end of pipe member 116 has a left hand thread, the coupling 118 also having different handed threads at its two ends. Accordingly, when the coupling 118 is turned in the direction of arrow 128, the effective length of the corner brace 112 is shortened, while turning in the opposite direction effectively lengthens the corner brace. Since the foot 124 is fixed in position on the floor, lengthening or shortening of the corner brace 112 results in shifting of the shoring apparatus in a lateral direction by a small amount. A handle 130 is fixed to the coupling 118 to facilitate hand rotating of the coupling. Shifting of the shoring structure is normally accomplished by rotating the couplings 118 on one of the corner braces 110 or 112 at each of the four corners of the apparatus. Thus, a workman can make a slight lateral adjustment of the entire shoring apparatus, after it has been set up, in a very simple manner.

Figure 12:
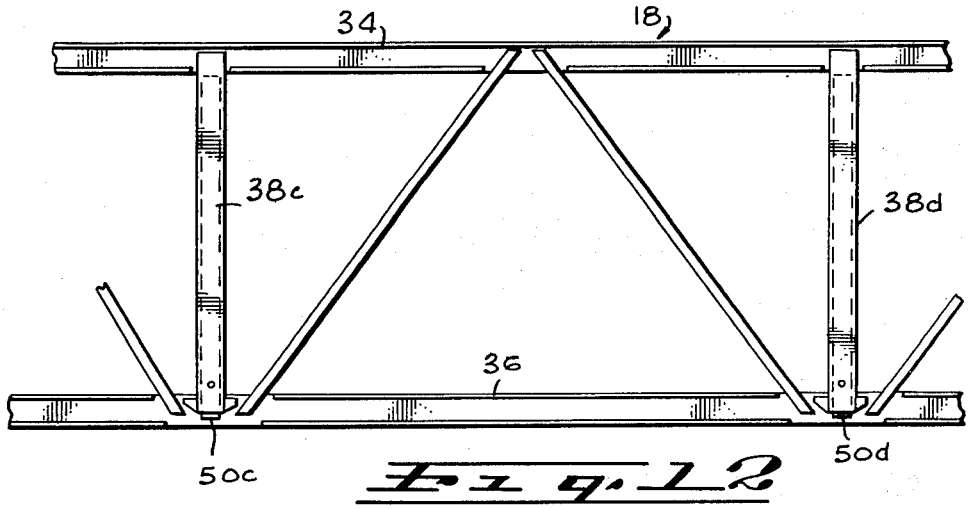
FIG. 12 is a side elevation view of the framework structure of FIG. 1, in a configuration for movement.

The movement of the shoring apparatus from one location to another in a building is accomplished by raising all of the lower column means 28, detaching the bracing members 22–25 from the structural frameworks 18, 20, and moving each framework such as 18 from one location to another. The raising of the lower column means 28 can be accomplished as indicated in FIG. 12, by telescoping all of the lower column members such as 50*c* and 50*d* into their corresponding upper column members 38*c*, 38*d*, so that the height of the structure is much less than the height between floors of the building. This permits the framework structure, with the lower column members 50 telescoped thereinto, to be moved as a unit within a story of a building or out of the building and onto another level thereof.

Figure 13:
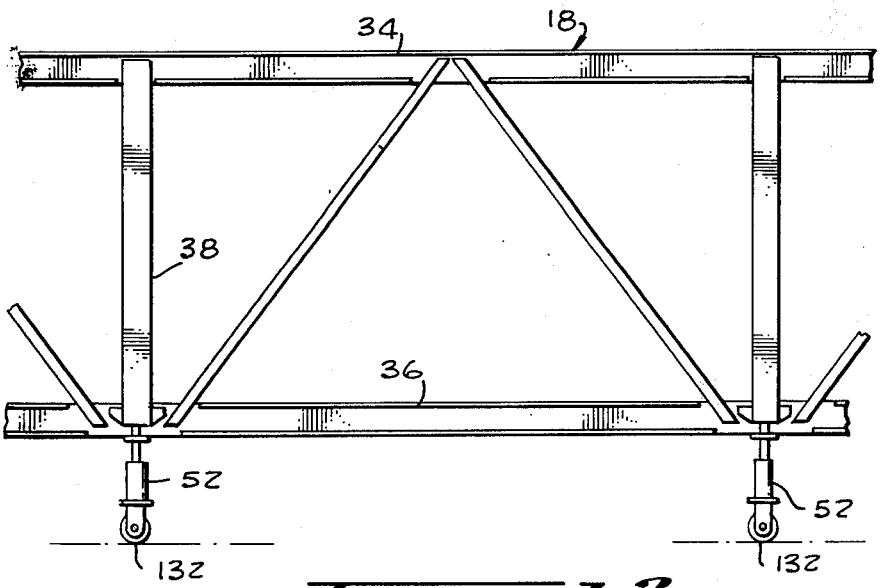
FIG. 13 is a view similar to FIG. 12, but with the jacks left in place and with rollers attached.
Figure 14:
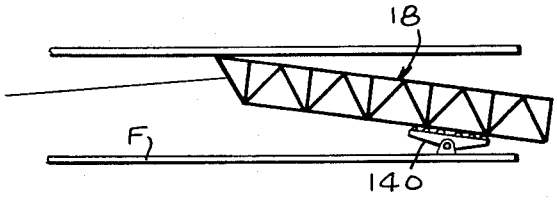
FIG. 14 is a simplified side elevation view of a framework and roller apparatus constructed in accordance with another embodiment of the invention, showing how the roller apparatus is utilized to move the framework in a building site.
Figure 15:
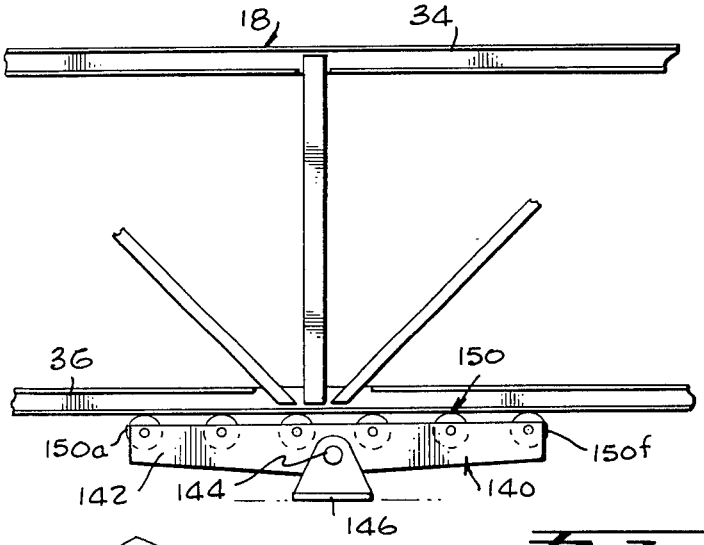
FIG. 15 is a more detailed side elevation view of the apparatus of FIG. 14.

The framework structure 18 can be moved in a number of different ways. One way is to remove the screw jacks 52 and to telescope the lower column members 50 so that their lower ends lie above the lower flanges of the beam 36. The framework structure 18 then can be moved along rollers that roll on the lower flanges of the lower beam 36, in the manner indicated in FIG. 4. Another way of moving the framework structure 18 is indicated in FIG. 13, wherein casters 132 are attached to the jacks 52 which are left attached to the lower column members. The framework structure 18 is then rolled on the casters 132. This method has the advantage that the jacks do not have to be taken off and put on, and they do not have to be carried separately from one location to the next. Of course, the casters 132 can be attached to separate long shafts so that they can be attached to the upper column members 38 or even to the lower beam 36, instead of directly to the jacks. In any case, the fact that the lower column members can telescope into the upper column members means that the lower column members do not have to be separately carried and that they can be rapidly deployed.

The movement of the framework 18 from one story of the building to the next is illustrated in FIGS. 4 and 5. The framework structure 18 is shown rolled along a floor F on a pair of rollers $R_1$ and $R_2$ out of the building while a safety line L holds the framework back. After the framework projects a small amount out of the building, a cable 138 extending from the crane C is attached to one end of the framework. After the center of the framework structure passes out of the building, a second cable 139 is attached. The crane C then moves the structure out of the building in a "flying' mode, hoists it up to the next floor level and then moves the structure back into the building.

The rolling of the framework structure is greatly facilitated by the fact that the lower beam 36 has flanges 88, 90 at the bottom which lie below the lower ends of the upper column members and diagonal members. The lower surface of the lower beam 36 provides a wide area that helps to distribute the weight of the structure onto a wide roller. Where a roller of a type shown at $R_2$ is utilized to support the structure, highly concentrated stresses can be produced during the final phase of rolling as in the configuration of FIG. 5. When the roller $R_2$ lies directly under one of the upper column members, the lower beam 36 is not highly stressed. However, when the roller $R_2$ bears against a portion of the lower beam 36 that lies about halfway between two upper column members, very high bending stresses are produced in the lower beam 36. In order to eliminate the need for a much stronger and heavier lower beam, a roller structure of the type illustrated in FIGS. 12 and 13 at 140 is provided.

The roller structure 140 includes a long support 142 which is pivotally mounted at 144 on a base 146 that is designed to rest on the floor or on the ground. A group of several rollers 150 is rotatably mounted on the support 142, the rollers being spaced from one another along the length of the structural framework 18 being moved thereon to provide a considerable separation between the first and last rollers 150*a*, 150*f*. The distance between the first and last rollers can be relatively short such as half of the spacing of the upper column members, and the rollers will still distribute the weight of the framework so that the stress concentration on the lower beam 36 is minimized. The fact that the support 142 on which the rollers are mounted can pivot about the point 144, means that the weight of the framework will not lie only on one roller, since a high proportion of weight on one of the rollers such as 150*f* will cause the entire support to tilt. The elimination of concentrated stresses means that a much lighter weight lower beam can be utilized without greatly increasing the possibility of failure during the movement of the framework.

Figure 16:
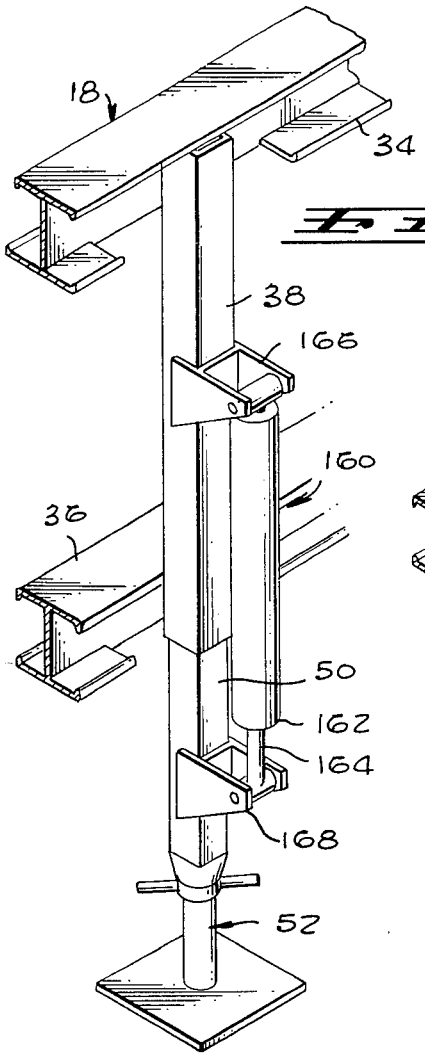
FIG. 16 is a partial perspective view of a hold-down device of another embodiment of the invention, and utilized with the shoring apparatus of FIG. 1.

The provision of upper and lower column members 38, 50 that slide into one another, permits the rapid attachment of simple devices to lower and remove the shoring apparatus from the concrete. As has been described above, the shoring apparatus can be collapsed in height by telescoping the lower column members into the upper column members. However, a device is necessary to hold up the shoring structure as the lower column members are being telescoped up, and to then slowly lower the shoring apparatus to the ground or onto rollers. Large scissor bed jacks have been utilized to support and then slowly lower shoring apparatus, but the use of several scissors jacks or one large scissors jack to provide stability results in additional apparatus that must be separately moved around a building site and which can add considerably to cost. FIG. 16 illustrates a lowering device 160 which can be utilized to lower the framework structure 18 and telescope the lower column members 50 into the upper column members 38.

The lowering device 160 of FIG. 16 includes a hydraulic cylinder 162 and piston 164, an upper bracket 166 for attaching the cylinder to the upper column member 138 and a lower bracket 168 for attaching the piston 164 to the lower column member 50. The framework structure 18 is lowered by first attaching the lowering device 60 as shown, then removing the pin 100 (FIG. 8), that previously prevented telescoping of the lower column member into the upper one, and then opening a valve (not shown) from the hydraulic cylinder 162 to a reservoir to permit the piston 164 to slowly move into the cylinder 162 to lower the framework structure 18. Similar lowering devices 160 are utilized for some or all of the column members to lower the framework structure. The framework structure can be lowered onto rollers that will roll along the lower beam 36, or casters may be attached to the lower beam or other parts prior to the framework structure being fully lowered.

The hydraulic cylinder 162 may have a relatively small diameter, and therefore a relatively low cost hydraulic assembly can be utilized. Such a cylinder could not be utilized by itself to lower a structure by many feet, because a small diameter piston 164 cannot be relied upon as a column member when it is very long. However, when used in conjunction with the telescoping column member 38, 50 which prevents large misalignment, a relatively small diameter hydraulic cylinder and piston can be utilized to lower the structure. Each of the brackets 166, 168 can be attached by pins that project through additional holes in the telescoping column member.

Figure 17:
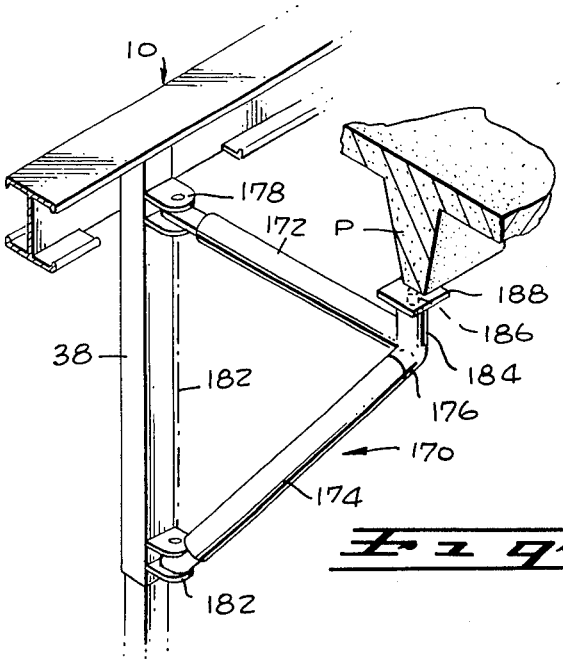
FIG. 17 is a partial perspective view of a hold-down apparatus constructed in accordance with still another embodiment of the invention.

In many situations, the concrete forms are attached to the shoring apparatus so that after the poured concrete sets the forms can be pulled down by merely lowering the shoring apparatus. However, the forms may stick tightly enough to the set concrete so that the forms will not fall down even if the entire weight of the shoring apparatus is applied to them. FIG. 17 illustrates a pull-down apparatus 170 which can be utilized to forcefully push down the shoring apparatus 10. The pull-down apparatus includes a horizontal swing arm 172 and a diagonal swing arm 174, which are joined together at their outer ends by a connector 176. The inner end of the horizontal swing arm is pivotally mounted by a bracket 178 on the upper column member 38, while the lower end of the diagonal swing arm is pivotally mounted by a bracket 180 at the lower end of the upper column member. The brackets 178, 180 permit the swing arm structure to pivot about a vertical axis 182. A hydraulic cylinder 184 mounted on the outer connector 176 carries a hydraulic piston 186 which supports a pad 188. The pad 188 lies below a beam portion P of a formed concrete floor, and the shoring apparatus 10 is moved down by pumping oil into the hydraulic cylinder 184 to push up the piston and pad 188 to press up the beam portion P of the floor. When enough force is exerted, the shoring apparatus 10 will move down by a small amount such as one-half inch relative to the beam portion P, which is often sufficient to break loose any concrete forms that are fastened to the shoring structure 10. The use of the swing arm 172, 174 permits the apparatus to be swung to a position where the pad 188 can lie under the beam portion of a floor, which is the portion that can best withstand a large upward thrust. Another method for forcefully moving down the shoring structure includes attaching the bracket 168 (FIG. 10) of the hydraulic cylinder to the lower floor, and operating the cylinder to pull down the opposite bracket 166.

Thus, the invention provides shoring apparatus which includes framework structures of light weight for movement as a unit between different locations in a building site. The framework structure includes upper and lower beams that are joined by vertical column members and by diagonal members. Each of the upper column members is separately mounted on the ground by a lower column means that is adjustable in height so that all of the upper column members can be positioned to maintain the upper beam horizontal and largely free of sagging. Nearly all of the loading forces encountered in supporting forms filled with wet concrete is transmitted to the lower column means and then to the floor below, by actual compression of the upper column members and diagonal members, rather than primarily by bending of the beams. This results in deflection occurring substantially only by reason of axial shortening of the upper column members and diagonal members, which is negligible even in the case of materials of low modulus of elasticity such as aluminum. In order to constitute a framework structure of appreciable length, the structure must be long enough so that there are at least two spans of the upper and lower beams that are joined by vertical column members, and therefore, there must be at least three upper column members and normally more than that. Each of the lower column means includes a lower column member that telescopes into an upper column member and can be held at different positions therealong. This permits the lower column member to be telescoped up into the upper column member for movement with the rest of the framework structure around a building. Also, this permits the same shoring structure to be utilized in a building that must be formed with floors of different heights above the floor below. The jack or fine adjusting mechanism at the bottom of each lower column member permits the fine adjustment that is needed to maintain each upper column member at the proper height. The column members also can be utilized to support hydraulic cylinders of pull down devices that forceably pull concrete forms down from set concrete.

Although particular embodiments of the invention have been described and illustrated herein, it is recognized that modifications and variations may readily occur to those skilled in the art and consequently, it is intended that the claims be interpreted to cover such modifications and equivalents.

I claim:

1. A concrete forming structure for forming an upper concrete floor at a distance above a lower concrete floor comprising:

a pair of elongated framework structures, each including a substantially horizontal upper beam extending along the length of the structure, a substantially horizontal lower beam below the upper beam, and a plurality of spaced tubular upper column members fixed at their upper ends to the upper beam and at their lower ends to the lower beam, said framework structures spaced from one another and extending substantially parallel to each other;

a plurality of detachable bracing members extending between the pair of framework structures;

a plurality of purlin members extending between and supported on the upper beams of the pair of laterally spaced framework structures;

a concrete floor form supported on the purlin members; and a plurality of adjustable lower column members each slideably disposed in a corresponding upper column member to support the upper column member on a floor that lies below the framework structures;

each lower beam including a lower flange which lies below the lower ends of the upper column members; and each lower column member is detachable from a corresponding upper column member, whereby to permit each framework structure to be rolled along the bottom of its lower beam.

2. A concrete forming structure for forming an upper concrete floor at a distance above a lower concrete floor comprising:

a pair of elongated framework structures, each including a substantially horizontal upper beam extending along the length of the structure, a substantially horizontal lower beam below the upper beam, and a plurality of spaced tubular upper column members fixed at their upper ends to the upper beam and at their lower ends to the lower beam, said framework structures spaced from one another and extending substantially parallel to each other;

a plurality of detachable bracing members extending between the pair of framework structures;

a plurality of purlin members extending between and supported on the upper beams of the pair of laterally spaced framework structures;

a concrete floor form supported on the purlin members; and a plurality of adjustable lower column members each slideably disposed in a corresponding upper column member to support the upper column member on a floor that lies below the framework structures;

each lower beam including a lower flange which lies below the lower ends of the upper column members; and each lower column member is upwardly slideable far enough into a corresponding upper column member that the lower end of the lower column member lies above the level of the bottom of the lower beam.

* * * * *